US007032394B2

(12) United States Patent
Seeliger

(10) Patent No.: US 7,032,394 B2
(45) Date of Patent: Apr. 25, 2006

(54) METHOD AND APPARATUS FOR CHECKING A PRESSURE MONITORING DEVICE OF A COMPRESSION REFRIGERATING PLANT

(75) Inventor: Rene Seeliger, Bayreuth (DE)

(73) Assignee: KKW Kulmbacher Klimageraete-Werk GmbH, Kulmbach (DE)

( * ) Notice: Subject to any disclaimer, the term of this patent is extended or adjusted under 35 U.S.C. 154(b) by 0 days.

(21) Appl. No.: 11/141,293

(22) Filed: May 31, 2005

(65) Prior Publication Data

US 2005/0217283 A1 Oct. 6, 2005

Related U.S. Application Data

(63) Continuation of application No. PCT/EP03/12991, filed on Nov. 20, 2003.

(30) Foreign Application Priority Data

Dec. 13, 2002 (DE) ..... 102 58 744

(51) Int. Cl.

| | |
|---|---|
| ***G01K 13/00*** | (2006.01) |
| ***F25D 17/00*** | (2006.01) |
| ***F25B 1/00*** | (2006.01) |
| ***F25B 49/00*** | (2006.01) |

(52) U.S. Cl. ..... 62/129; 62/181; 62/228.3

(58) Field of Classification Search ..... 62/126, 62/129, 228.3, 228.5, 178, 180, 181
See application file for complete search history.

(56) References Cited

U.S. PATENT DOCUMENTS

| | | | | |
|---|---|---|---|---|
| 4,848,096 | A * | 7/1989 | Funahashi et al. | 62/126 |
| 5,522,231 | A * | 6/1996 | Kenyon et al. | 62/129 |
| 5,586,443 | A | 12/1996 | Lewis | |

FOREIGN PATENT DOCUMENTS

| | | |
|---|---|---|
| DE | 39 28 430 C1 | 3/1991 |
| EP | 0 453 302 A1 | 10/1991 |
| EP | 1 022 525 A1 | 7/2000 |
| WO | 00/31451 | 6/2000 |

* cited by examiner

*Primary Examiner*—Marc Norman
(74) *Attorney, Agent, or Firm*—Laurence A. Greenberg; Werner H. Stemer; Ralph E. Locher

(57) ABSTRACT

A pressure monitoring device of a compression refrigerating plant having a compressor, a condenser and an energy discharge device cooperating with the latter, is tested by an automatically proceeding self-test program. In this case, the energy discharge device is at least throttled back and the compressor is operated up to a response point of the pressure monitoring device.

12 Claims, 2 Drawing Sheets

METHOD AND APPARATUS FOR CHECKING A PRESSURE MONITORING DEVICE OF A COMPRESSION REFRIGERATING PLANT

CROSS-REFERENCE TO RELATED APPLICATION

This is a continuing application, under 35 U.S.C. § 120, of copending international application No. PCT/EP2003/012991, filed Nov. 20, 2003, which designated the United States; this application also claims the priority, under 35 U.S.C. § 119, of German patent application No. 102 58 744.2, filed Dec. 13, 2002; the prior applications are herewith incorporated by reference in their entirety.

BACKGROUND OF THE INVENTION

FIELD OF THE INVENTION

The invention relates to a method and an apparatus for checking a pressure monitoring device of a compression refrigerating plant which has a compressor, a condenser and an energy discharge device cooperating with the latter, for example in the form of at least one fan. The invention relates furthermore, to an apparatus suitable for executing the method.

Safety devices of refrigerating plants must, as a rule, be checked annually according to industrial standards, in particular EN 378. A compression refrigerating plant is equipped, in general, with at least one pressure monitoring device. Pressure monitoring devices in this context mean both pressure monitors and pressure limiters and safety pressure limiters. A pressure monitor makes it possible, after it has responded, to switch the refrigerating plant on again automatically. By contrast, a pressure limiter requires manual resetting, and a safety pressure limiter requires resetting by a tool. It is not possible, as a rule, for personnel of the operator of the refrigerating plant to check a pressure monitoring device.

SUMMARY OF THE INVENTION

It is accordingly an object of the invention to provide a method and an apparatus for checking a pressure monitoring device of a compression refrigerating plant which overcomes the above-mentioned disadvantages of the prior art methods and devices of this general type, which is particularly user-friendly for checking a pressure monitoring device of the compression refrigerating plant.

With the foregoing and other objects in view there is provided, in accordance with the invention, a method of checking a pressure monitoring device of a compression refrigerating plant. The compression refrigerating plant has a compressor, a condenser and an energy discharge device cooperating with the condenser. The pressure monitoring device is disposed in a high-pressure part of the compression refrigerating plant between the compressor and the condenser. The method includes the performance of an automatically proceeding self-test program. The self-test program includes the steps of throttling back the energy discharge device, and operating the compressor up to a response point of the pressure monitoring device.

In this case, a compression refrigerating plant of basically known construction has a compressor, for example, an air-cooled condenser and an energy discharge device cooperating with the latter, in particular in the form of at least one fan. The term "refrigerating plant" includes both a refrigerating plant serving for cooling and a heat pump and also combined plants. The refrigerating plant is equipped with a pressure monitoring device which can be checked by an automatically proceeding self-test program. In this case, the energy discharge device is at least throttled in that, for example, the fan rotational speed is lowered, but is preferably shut down completely or not put into operation, while the compressor is operated up to the response of the pressure monitoring device. An automatic process of the self-test program results in that, although the latter is started by the user, it continues to proceed automatically. The process of the self-test program is terminated either automatically or by the action of the user.

A particular advantage of the self-test program is that the respective operating states of individual components of the refrigerating plant, to be precise of the compressor or compressors, on the one hand, and of the energy discharge device, on the other hand, do not have to be set separately by the user, but, instead, are selected automatically as the self-test program proceeds. Preferably, the self-test program can be set in motion by a single starting command, for example by actuation of a key switch. This, in particular, also makes it possible in a simple way for the user of the refrigerating plant to check the pressure monitoring device.

According to a preferred refinement, the process of the self-test program is stored automatically. Consequently, the execution of the check of the pressure monitoring device can be documented in a user-friendly way and the possibility of later evaluations of executed checks is afforded.

The triggering of the self-test program is normally expedient only at relatively long time intervals, for example annually or quarterly. A more frequent response of the pressure monitoring device may give indications as to defects in a plant both in instances where this takes place during the operation of the refrigeration plant without the intervention of the personnel and in the case of a deliberate frequent switch-on of the test program. For this reason, according to a preferred development, a safety mechanism is provided, by which the supply of energy to the compressor is interrupted or interlocked automatically when a maximum number, for example three, of triggerings of the pressure monitoring device per unit time, for example per day, is exceeded. A cancellation of the interruption or interlocking may be provided, inter alia as a function of the type of pressure monitoring device, for example by a manual unlocking or by unlocking by use of a tool.

The refrigerating plant preferably has a further pressure indicator device in addition to the measuring and regulating devices, in particular the pressure monitoring device to be checked, which cooperate with the self-test program. This affords an additional possibility for monitoring the process of the self-test program by the operating personnel, in which case the process of the self-test program can be stopped at any time.

The advantage of the invention is, in particular, that, by the test method for testing the function of a pressure monitoring device of a compression refrigerating plant being automated, this test method can be executed in a particularly efficient and simple way by personnel of the operator of the refrigerating plant.

Other features which are considered as characteristic for the invention are set forth in the appended claims.

Although the invention is illustrated and described herein as embodied in a method and an apparatus for checking a pressure monitoring device of a compression refrigerating plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
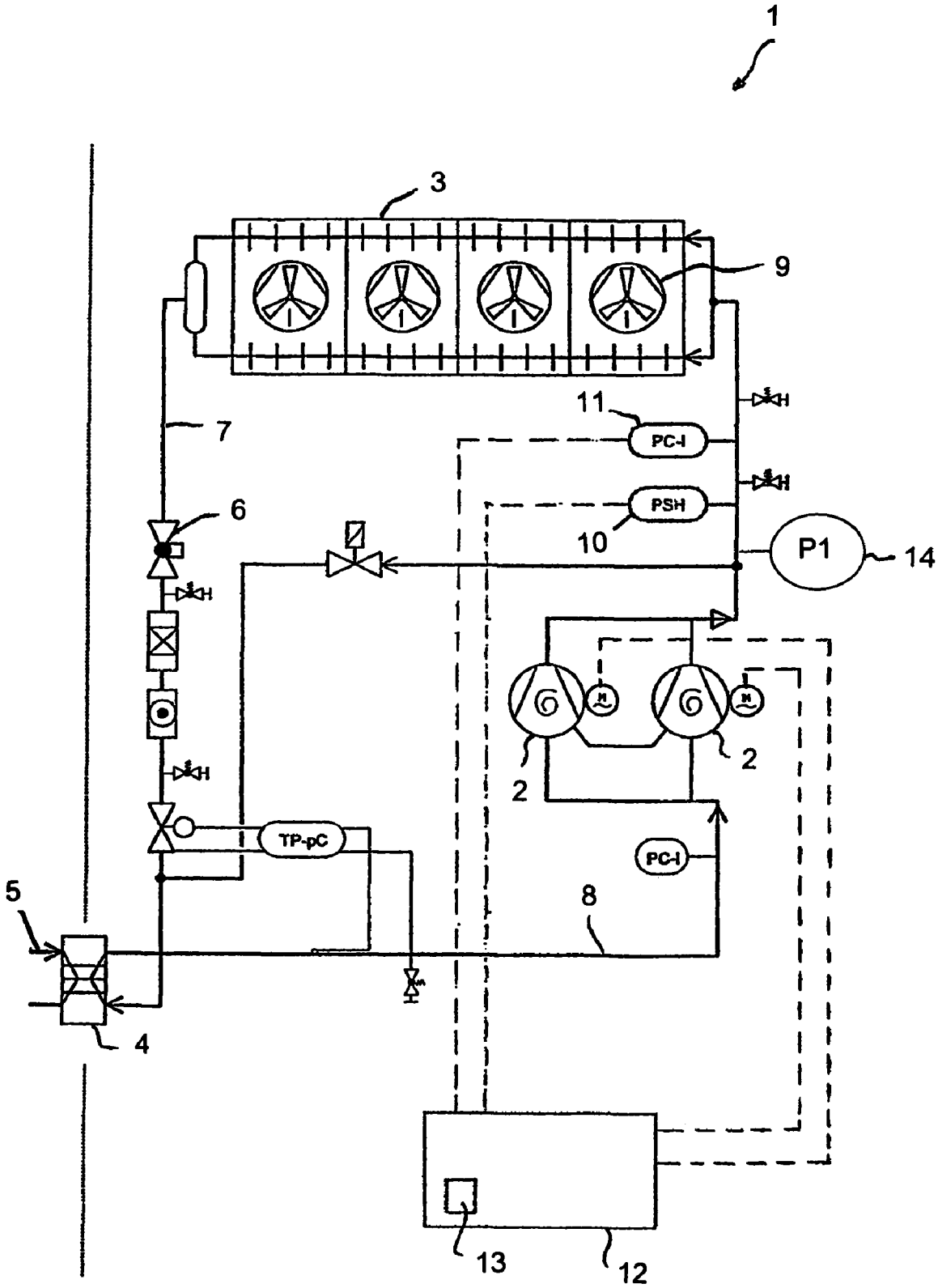
FIG. 1 is a diagrammatic illustration of a refrigerating plant with a self test module according to the invention.

In all the figures of the drawing, sub-features and integral parts that correspond to one another bear the same reference symbol in each case. Referring now to the figures of the drawing in detail and first, particularly, to FIG. 1 thereof, there is shown, in a simplified view, the functioning of a refrigerating plant 1 which is equipped with two compressors 2, one condenser 3 and one evaporator 4. The evaporator 4 serves for cooling a water circuit 5 that is only basically illustrated. Both an expansion member 6 following the condenser 3 in the refrigerating circuit and also the compressors 2 separate a high-pressure side 7 of the refrigerating circuit from a low-pressure side 8. The condenser 3 is air-cooled by four fans 9 as energy discharge devices.

On the high-pressure side 7 of the refrigerating plant 1, the connection pieces of a pressure monitoring device 10 and of a pressure regulating device 11 are located upstream of the condenser 3 in the direction of flow of the refrigerant. The monitoring and regulating devices 10, 11 are operatively connected, indicated by broken lines, to a control and regulating device 12 which is also linked to the motors of the compressors 2. With the aid of the pressure regulating device 11, for example, the individual fans 9 of the condenser 3 can be switched on or off in a controlled manner in order to set the condensation pressure of the refrigerant. The pressure monitoring device 10 is configured as a pressure monitor. As soon as the pressure of the refrigerant on the high-pressure side 7 exceeds a permissible maximum value ps, the compressors 2 are shut down automatically. At a predetermined out time, the compressors 2 can start again automatically.

The pressure monitoring device 10 is tested automatically by the method according to the invention. In this case, the user sets a self-test program in motion by actuating a key switch 13. In this program, the process of which is controlled by the control and regulating device 12 functioning as a self-test module, the fans 9 are switched off while the compressors 2 are switched on and remain switched on insofar as they are already in operation at the start of the program. As a result of the drastically reduced energy discharge of the condenser 3, the pressure of the refrigerant on the high-pressure side 7 rises. With the pressure monitoring device 10 functioning as intended, the latter shuts down the compressors 2 when the permissible maximum pressure ps is reached. During the entire process of the self-test program, the pressure of the refrigerant on the high-pressure side 7 continues to be measured via a pressure transmitter (FIG. 2), using the pressure regulating device 11, and continues to be indicated via the control and regulating device 12. When the measured pressure exceeds the permissible maximum pressure ps, an optical and/or acoustic warning which requires the user to shut down the compressors 2 takes place via the control and regulating device 12. In addition, a manometer 14 is provided, which indicates the pressure of the refrigerant on the high-pressure side 7 independently of the control and regulating device 12.

Figure 2:
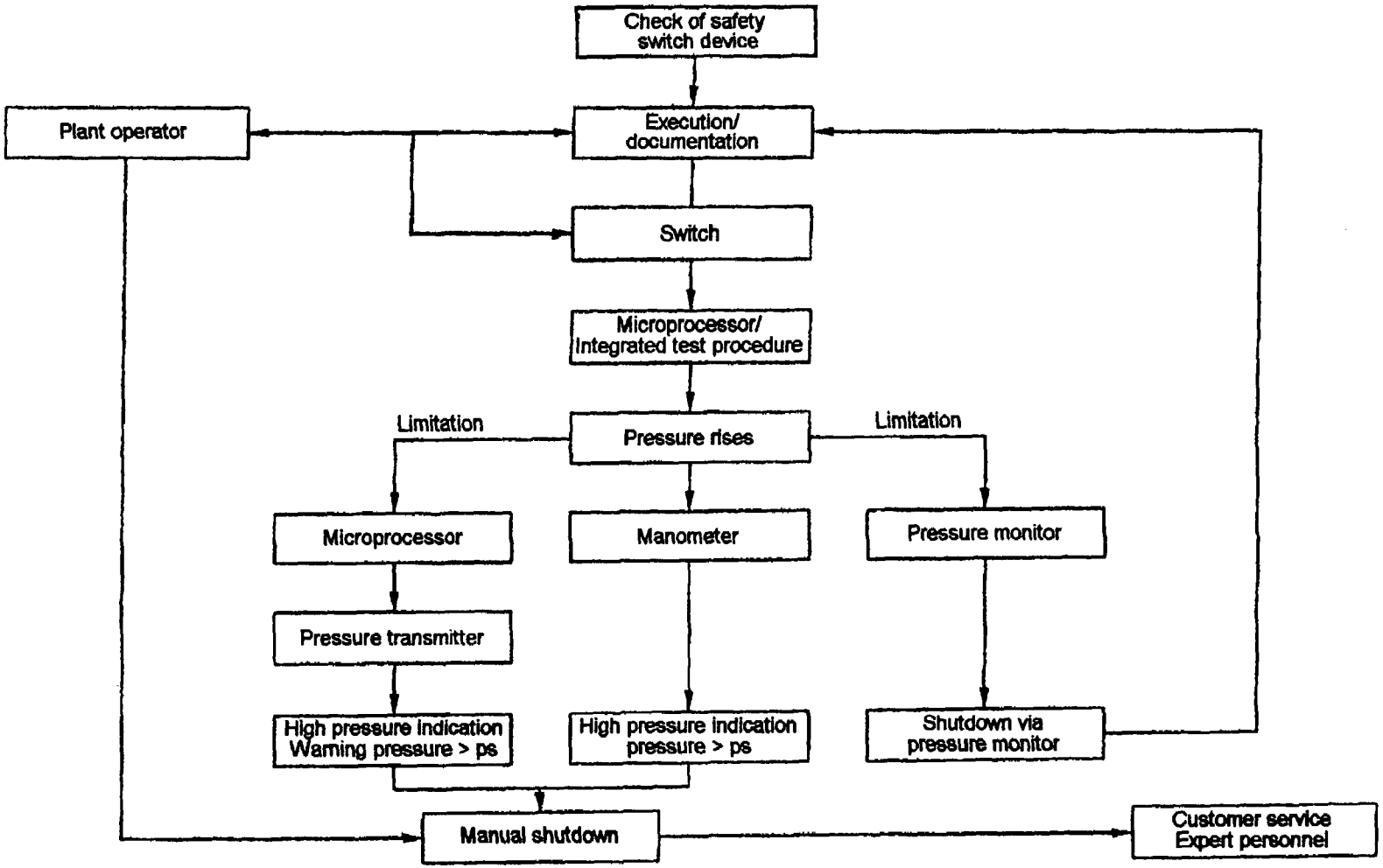
FIG. 2 is a flow diagram of a method for checking a pressure monitoring device which can be executed by the refrigerating plant shown in to FIG. 1.

FIG. 2 illustrates the process of the check of the pressure monitoring device 10 of the refrigerating plant 1 according to FIG. 1. The entire test is executed by the plant operator. The operator, assisted by the control and regulating device 12, likewise assumes the documentation of the executed test. Authorized personnel of the operator set the test procedure in motion, as a rule once a year, by actuation of the key switch 13. The refrigerant content of the refrigerating plant 1 is dimensioned such that it is sufficient to equip the latter solely with a pressure monitor as the pressure monitoring device 10, but not with a pressure limiter or safety pressure limiter. If the pressure monitoring device 10 operates without defects, then there is no need for any further action by the personnel after the starting of the self-test program. Parameters of the executed test process are stored automatically in the or with the aid of the control and regulating device 12. Only when there is a statistically improbable malfunction of the pressure monitoring device 10 leading to the exceeding of the permissible maximum pressure ps does the operator, after shutting down the refrigerating plant 1 by hand, have to get in touch with the customer service looking after the refrigerating plant 1.

I claim:

1. A method of checking a pressure monitoring device of a compression refrigerating plant, the compression refrigerating plant having a compressor, a condenser and an energy discharge device cooperating with the condenser, the pressure monitoring device disposed in a high-pressure part of the compression refrigerating plant between the compressor and the condenser, which comprises the steps of:

performing an automatically proceeding self-test program, which includes the steps of:

throttling back the energy discharge device; and operating the compressor up to a response point of the pressure monitoring device.

2. The method according to claim 1, which further comprises starting the self-test program if an operator of the compression refrigerating plant triggers a single starting command performed by actuating a switch.

3. The method according to claim 1, which further comprises storing process proceedings of the self-test program automatically in a control and regulating device.

4. The method according to claim 1, which further comprises automatically interrupting a supply of energy to the compressor when a maximum number of triggerings of the pressure monitoring device per unit time is exceeded.

5. An apparatus for performing a self-test in a compression refrigerating plant, the compression refrigerating plant having a compressor, a condenser, and an energy discharge device cooperating with the condenser, the apparatus comprising:

a self-test module; and a pressure monitoring device connected and cooperating with said self-test module, said pressure monitoring device disposed in a high-pressure part of the compression refrigerating plant between the compressor and the condenser;

said self-test module programmed to perform an automatically proceeding self-test program, the self-test module programmed to:

throttle back the energy discharge device; and operate the compressor up to a response point of said pressure monitoring device.

6. The apparatus according to claim 5, wherein the energy discharge device is a fan controlled by said self-test module.

7. The apparatus according to claim 5, further comprising a pressure indicator device functioning independent of the self-test program.

8. The apparatus according to claim 5, further comprising a key switch connected to said self-test module for initiating a start of the self-test program.

9. A compression refrigerating plant, comprising:

a compressor;

a condenser;

an energy discharge device cooperating with said condenser;

a self-test module connected to and controlling said condenser; and a pressure monitoring device connected and cooperating with said self-test module, said pressure monitoring device disposed in a high-pressure part of the compression refrigerating plant between said compressor and said condenser;

said self-test module programmed to perform an automatically proceeding self-test program, said self-test module programmed to:

throttle back said energy discharge device; and operate said compressor up to a response point of said pressure monitoring device.

10. The compression refrigerating plant according to claim 9, wherein said energy discharge device is a fan.

11. The compression refrigerating plant according to claim 9, further comprising a pressure indicator device functioning independent of the self-test program.

12. The compression refrigerating plant according to claim 9, further comprising a key switch connected to said self-test module for initiating a start of the self-test program.

* * * * *